US009976756B2

(12) United States Patent
Reed

(10) Patent No.: US 9,976,756 B2
(45) Date of Patent: May 22, 2018

(54) RADIATOR BRACKETS FOR USE IN MOUNTING A RADIATOR UNDERNEATH A WINDOW

(71) Applicant: Edward Reed, Wales (GB)

(72) Inventor: Edward Reed, Wales (GB)

( * ) Notice: Subject to any disclaimer, the term of this patent is extended or adjusted under 35 U.S.C. 154(b) by 0 days. days.

(21) Appl. No.: 14/285,383

(22) Filed: May 22, 2014

(65) Prior Publication Data

US 2015/0338110 A1 Nov. 26, 2015

(51) Int. Cl.
*F24D 19/02* (2006.01)

(52) U.S. Cl.
CPC ..... *F24D 19/0209* (2013.01); *F24D 19/02* (2013.01); *F24D 19/0223* (2013.01); *F24D 19/0253* (2013.01)

(58) Field of Classification Search
USPC ..... 248/200, 205.1, 232, 233, 309.1
See application file for complete search history.

(56) References Cited

U.S. PATENT DOCUMENTS 3,636,766 A * 1/1972 Austin ..... B63B 19/24 73/861.75
4,815,683 A * 3/1989 Ferrante ..... F16M 13/02 248/205.2

FOREIGN PATENT DOCUMENTS

| | | | | |
|---|---|---|---|---|
| DE | 201 19 875 U1 | | 5/2003 | |
| EP | 0391048 A2 | * | 10/1990 | ..... B65G 1/02 |
| FR | 2795162 A1 | * | 12/2000 | ..... F24D 19/061 |
| GB | 2349801 A | * | 11/2000 | ..... F24D 19/02 |

* cited by examiner

*Primary Examiner* — Alfred Wujciak
(74) *Attorney, Agent, or Firm* — Edwin D. Schindler

(57) ABSTRACT

A radiator bracket connects a radiator to a support surface, such as a wall, and includes at least one vertically extending channel having a width that decreases from an open end to a narrow end with the narrow end being located closer to either the radiator or the support surface. The vertically extending channel can be a single channel or two channels. Where the bracket has a single channel, two brackets can be used with one of the brackets having its narrow end closest to the radiator and the other having its narrow end closest to the wall.

3 Claims, 7 Drawing Sheets

RADIATOR BRACKETS FOR USE IN MOUNTING A RADIATOR UNDERNEATH A WINDOW

FIELD OF THE INVENTION

The present invention concerns radiators and, in particular, the brackets used to attach a radiator to a support surface such as a wall.

BACKGROUND TO THE INVENTION

Radiators are more often than not positioned under a window. With the current design of radiator brackets, it is impossible to close full length curtains, that is to say, curtains which extend from the curtain rail to the bottom of the radiator. The brackets themselves prevent the curtains being overlapped behind the radiator.

STATEMENTS OF THE INVENTION

According to the present invention there is provided a bracket for connecting a radiator to a support surface, the bracket including an open channel section which, in use, extends substantially vertically, the channel section having a width which decreases from a relatively wide open end to a relatively narrow end, the closed end being positioned closer to one of the radiator and the support surface than the other. Preferably the bracket has means for connecting the bracket to one of said support surface and said radiator.

Preferably the bracket is provided with at least one arm which is slidable relative to the main body of the bracket and which enables the bracket to be used with radiators of varying sizes.

In one embodiment of the present invention, there is provided a bracket assembly for connecting a radiator to a support surface; the assembly comprising two brackets of the invention, which in use, are arranged with each bracket having a channel section and the two brackets, in use, being arranged with their respective channel sections overlapping with the closed end of one bracket being positioned closer to the radiator and the closed of the other bracket being positioned closer to the support surface.

In another embodiment of the present invention, a single bracket is provided with two adjacent channel sections arranged in overlapping manner so that, in use, the closed end of one of the channel sections is positioned closer to the radiator and the closed end of the other channel section is positioned closer to the support surface.

Accordingly the present invention overcomes the problem encountered with current radiator brackets, namely, the ability to be able to fully close the curtains behind the radiator. The pair of brackets according to one embodiment of the invention, or the single bracket according to the other embodiment of the present invention, are arranged relative to the radiators so that each curtain can be drawn into a respective channel section and the overlapping of the channel sections allows the curtains to be drawn into an overlapping position.

DETAILED DESCRIPTION OF THE INVENTION

The present invention will now be described, by way of examples only, with reference to the accompanying drawings.

Figure 1:
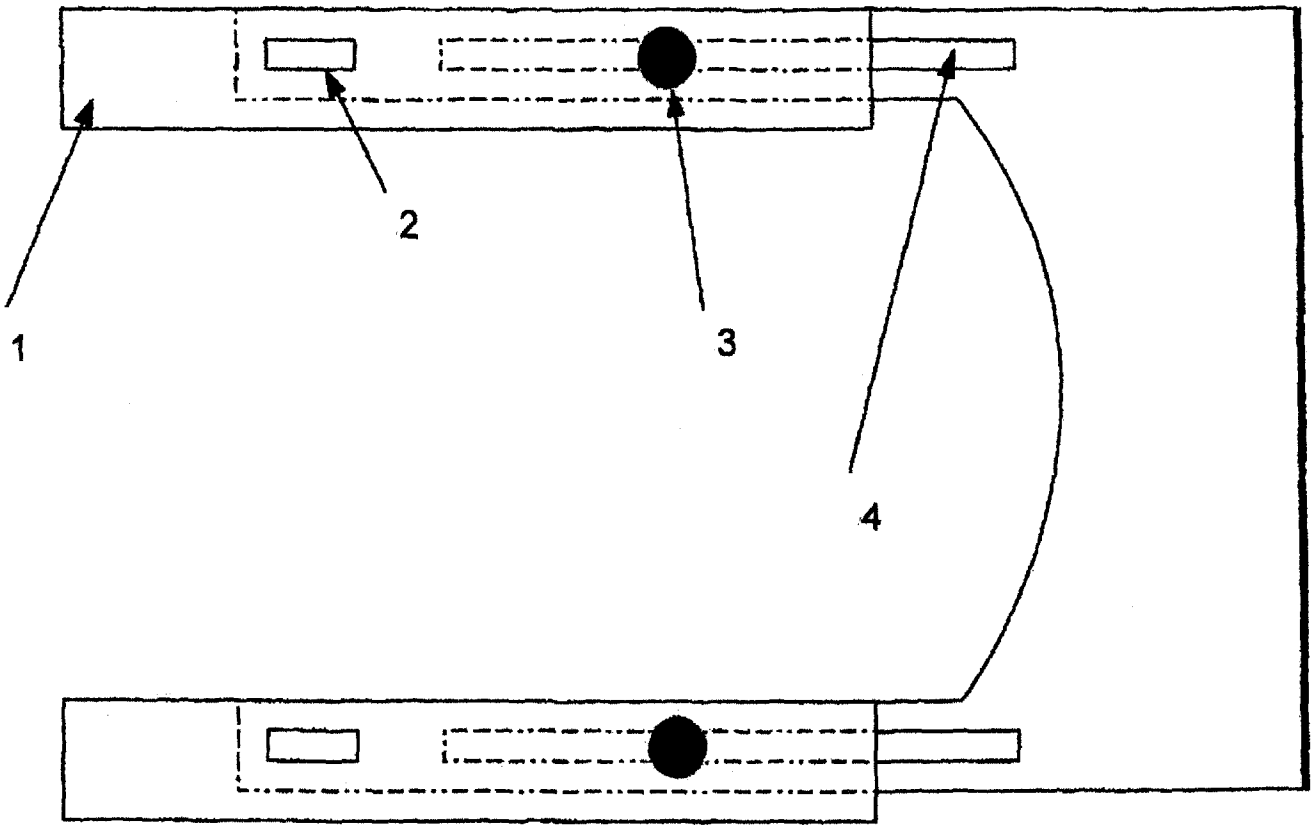
FIG. 1 is a front view of a first embodiment of a radiator bracket of the invention.
Figure 2:
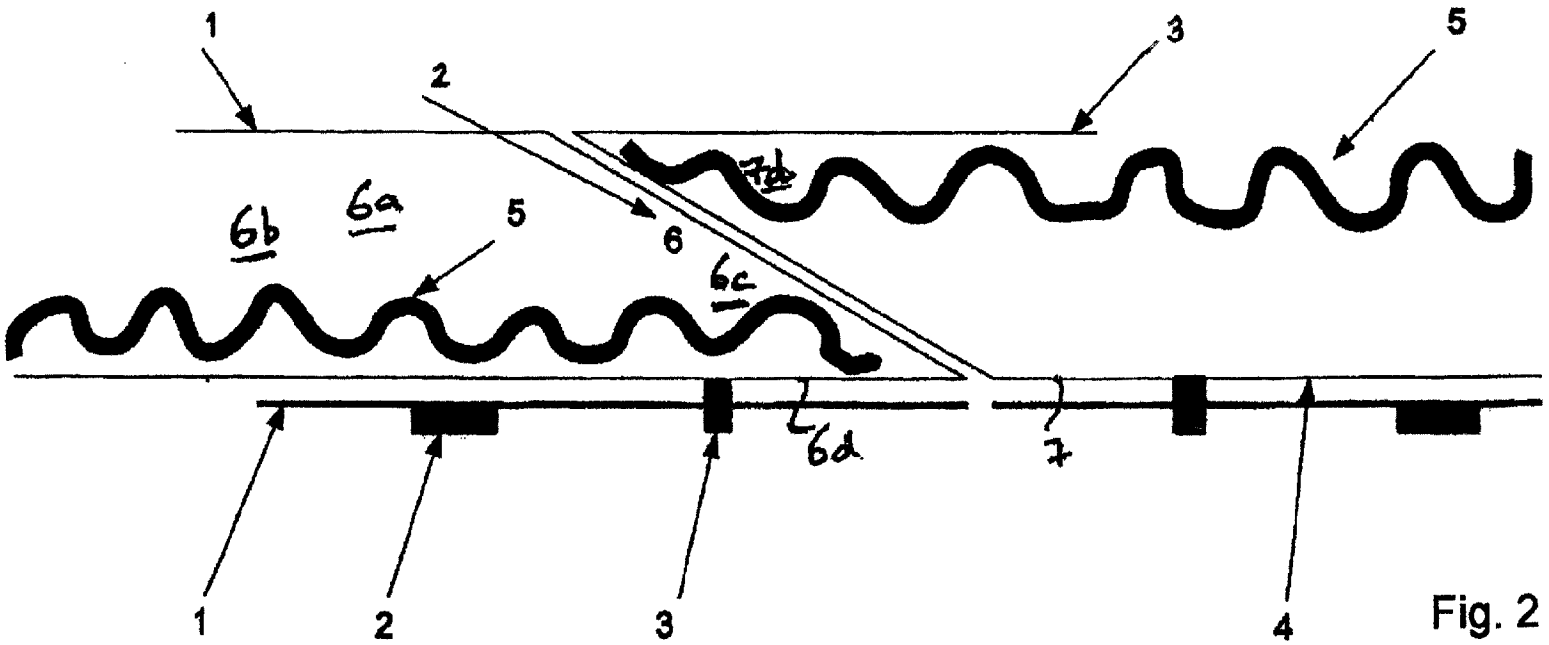
FIG. 2 is a plan view of a pair of radiator brackets in accordance with the first embodiment of the invention.
Figure 3:
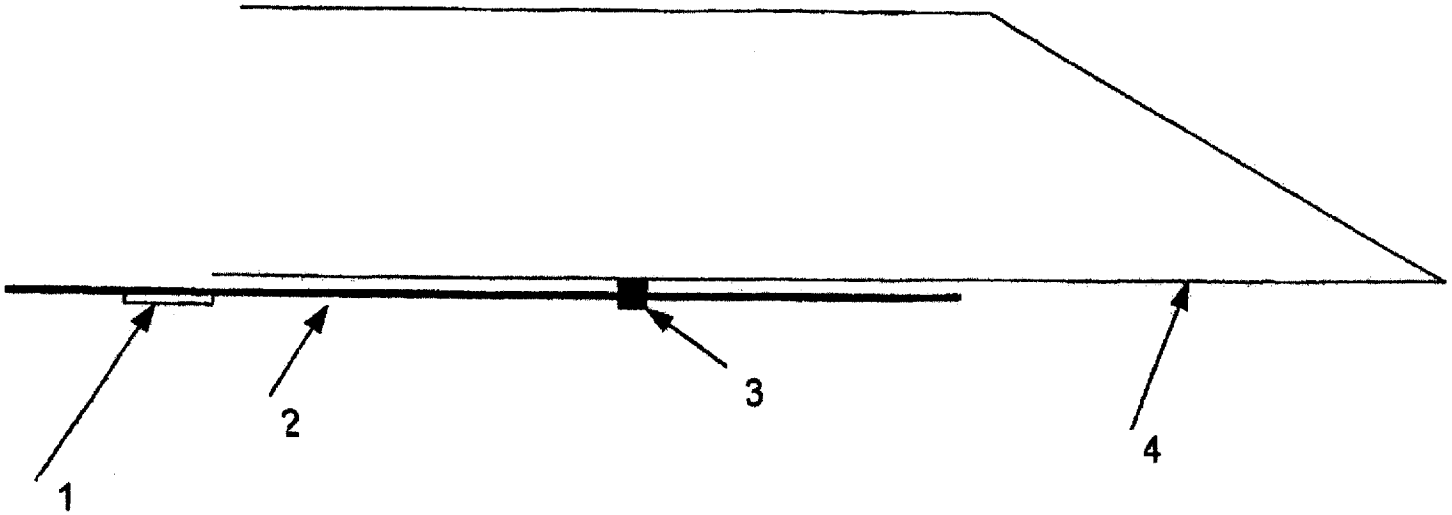
FIG. 3 is a plan view of the radiator bracket of FIG. 1.
Figure 4:
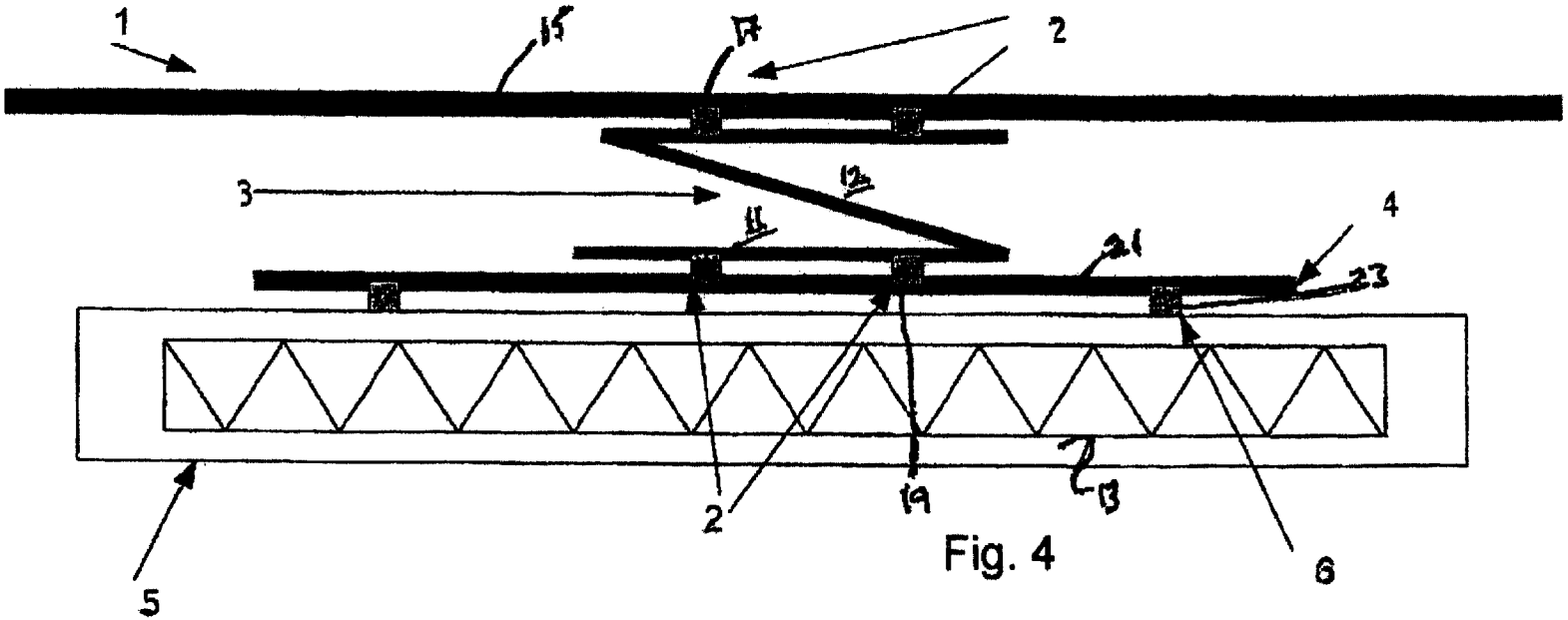
FIG. 4 is a plan view of a radiator bracket in accordance with a second embodiment of the invention, showing the bracket in use in attaching a radiator to a wall.
Figure 5:
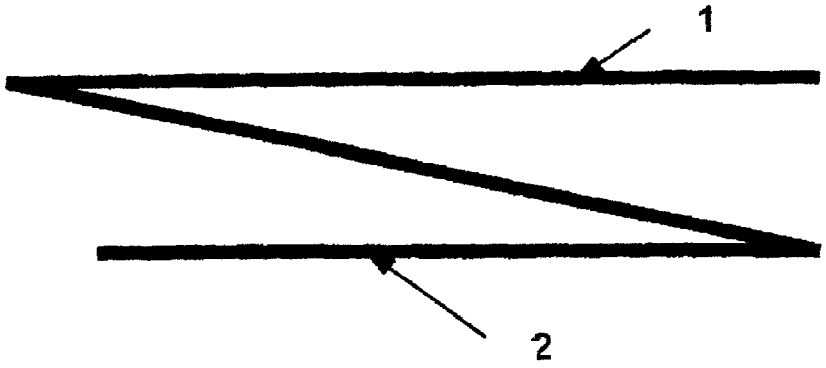
FIG. 5 is a plan view of the radiator bracket shown in FIG. 4.
Figure 6:
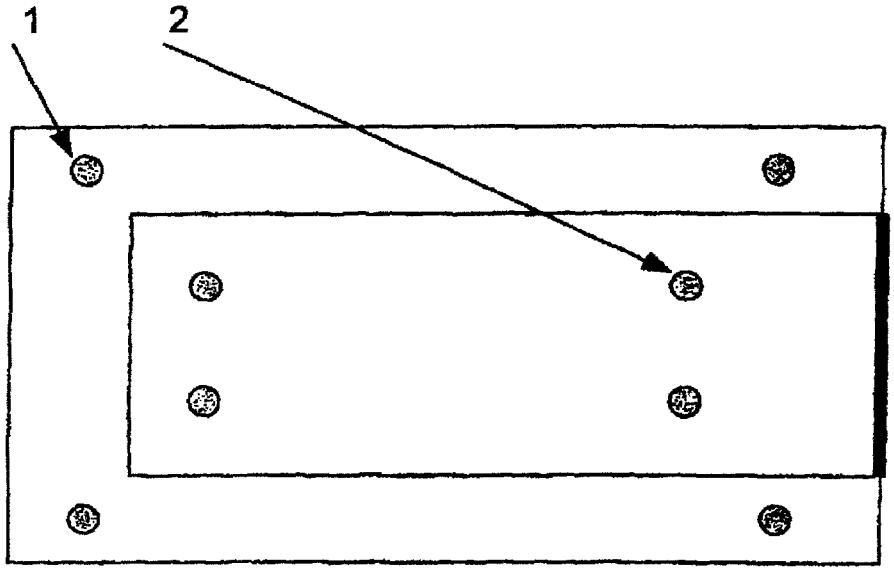
FIG. 6 shows the radiator bracket of FIG. 5 including its fixing holes.

Referring to FIGS. 1 to 3 of the accompanying drawings, a first embodiment of a radiator bracket in accordance to the present invention includes bracket member 6 which includes an open channel 6*a* having a width which decreases from a relatively wide open end at 6*b* to a relatively narrow closed end at 6*c*. For the left hand bracket 6*d* the closed end of channel 6*a* is closer, in use, to the radiator (not shown) and in the case of bracket 7 the closed end 7*d* is closer, in use, to the wall (not shown).

As illustrated in FIG. 2, the brackets 6 and 7 are arranged in overlapping fashion so that curtains 5 can be drawn to a closed position where the edges of the curtains themselves overlap with their respected brackets.

Each bracket is attached to a sliding arm or spar 1 and this allows the brackets to be attached to various size radiators, the radiators being locked on to locating tabs 2. They are locked off in the correct centres with locking screws 3 that are positioned within a slot in the main frame 4 and locking arms or spars 1.

FIG. 1 shows one of the brackets in the vertical plain with the channel and the adjustable radiator mounting arm running in the horizontal plain.

The brackets, 6, 7 can be made out of any suitable material, for example mild steel, aluminium, stainless steel or moulded plastics.

Referring to FIGS. 4 to 9 of the accompanying drawings, a second embodiment of the bracket in accordance with the present invention is provided with two adjacent channel sections 11, 12 arranged in an overlapping manner so that, in use, the closed end of one of the channel sections is positioned closer to the radiator and the closed end of the other channel section is positioned closer to the support surface 15, which may be a wall below a window. The bracket is provided with four fixing bolts 17 to enable the bracket to be fixed to the wall below the window. It is provided with four more fixing bolts 19 to enable the bracket to be fixed to the retaining spar 21. The retaining spar 21 is also provided with radiator locating hoops 23.

Figure 7:
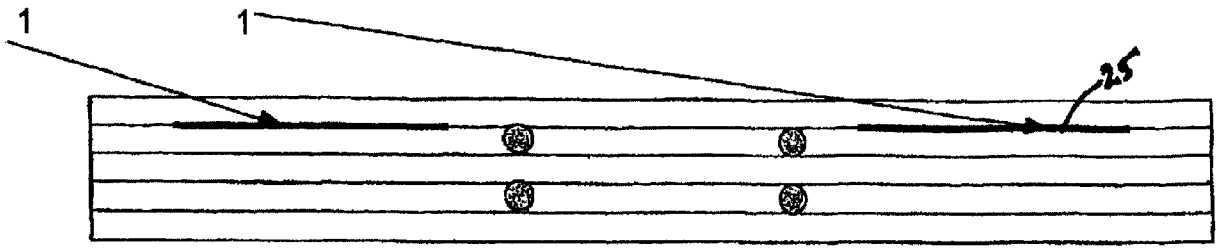
FIG. 7 shows a radiator retaining spar such as that shown also in FIG. 4.
Figure 8:
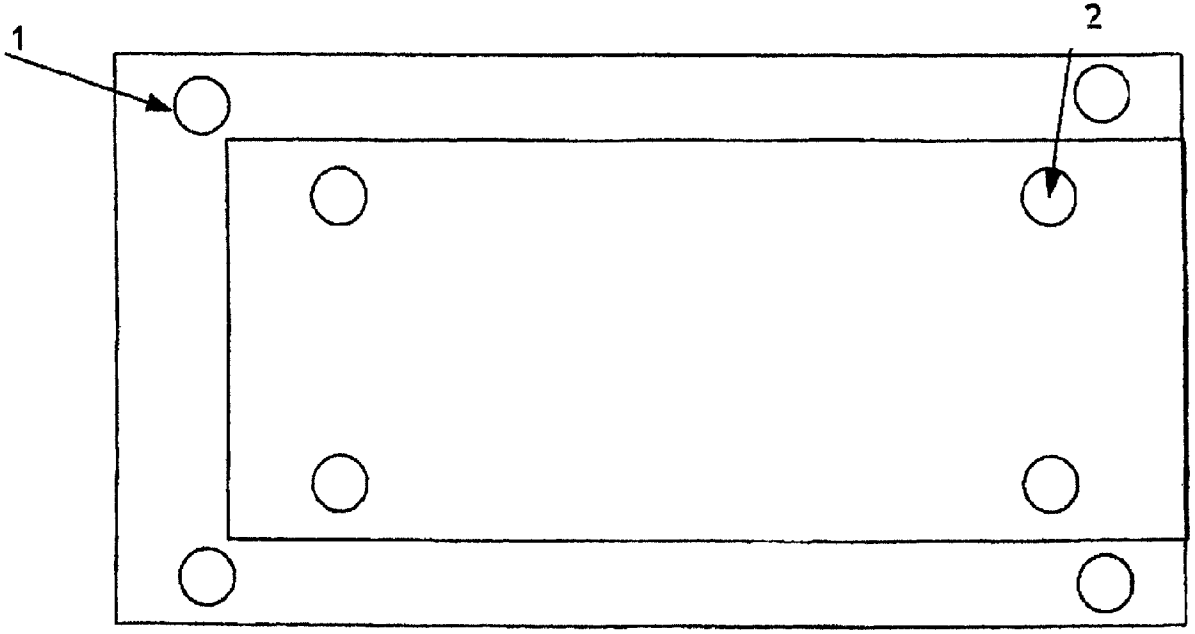
FIG. 8 shows a spar mounting bracket similar to that shown in FIG. 6.
Figure 9:
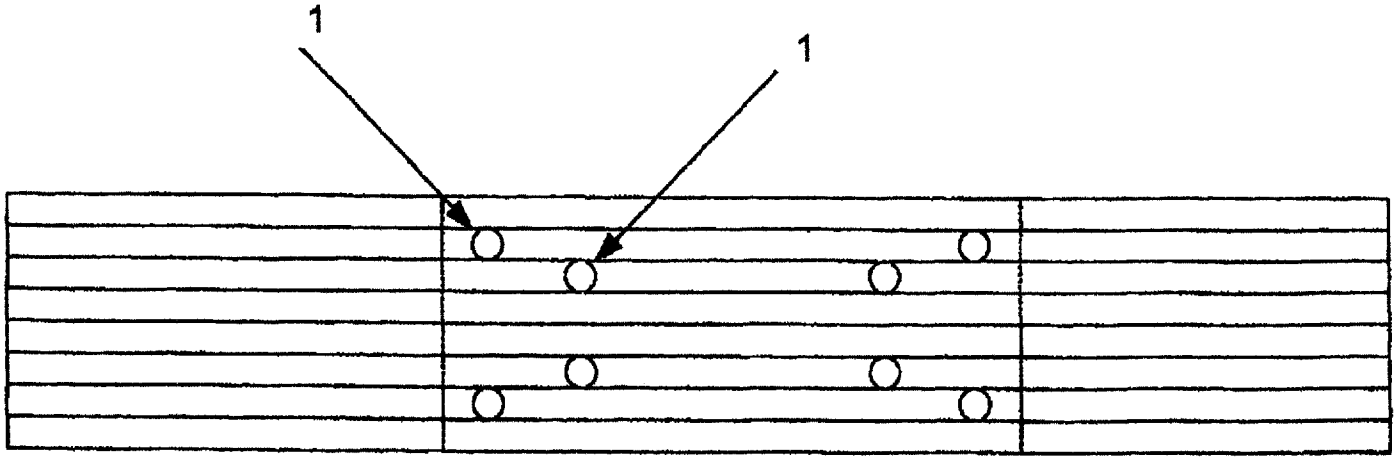
FIG. 9 is a front view of a radiator retaining spar.

FIG. 7 shows a radiator retaining spar 21 with radiator retaining slots 25.

What is claimed is:

1. A bracket for connecting a radiator to a support surface, comprising:

a radiator; and, the bracket comprising an open channel section extending substantially vertically, in use, said open channel section having a decreasing width from a relatively wide open end of said bracket to a relatively narrow, closed end of said bracket and being positioned closer to one of either said radiator or the support surface thereby connecting said radiator to the support surface, wherein said open channel section is a first channel section and further comprising a second channel section, said first channel section and said second channel section being adjacent one another and overlapping one another in a horizontal direction for being capable of supporting leading edges of curtains in an overlapping position behind the radiator so that, in use, the closed end of said first channel section is positioned closer to the radiator and a closed end of said second channel section is positioned closer to the support surface.

2. A bracket for connecting a radiator to a support surface in combination with curtains positioned in an overlapping manner behind the radiator, comprising:

the radiator;

curtains having leading edges; and, the bracket being in Z shaped, comprising a plurality open channel sections extending substantially vertically, in use, said open channel sections having a decreasing width from a relatively wide open end of said bracket to a relatively narrow, closed end of said bracket and being positioned closer to one of either said radiator or the support surface thereby connecting said radiator to the support surface, wherein said at least one of the plurality open channel sections is a first channel section and the other plurality open channel sections comprising a second channel section, said first channel section and said second channel section being adjacent one another and overlapping one another in a horizontal direction for being capable of supporting the leading edges of said curtains in an overlapping position behind the radiator so that, in use, the closed end of said first channel section is positioned closer to the radiator and a closed end of said second channel section is positioned closer to the support surface.

3. The bracket for connecting a radiator to a support surface in combination with curtains positioned in an overlapping manner behind the radiator according to claim 2, further comprising means for connecting said bracket to one of the radiator and the support surface.

* * * * *